United States Patent [19]

Mason et al.

[11] 4,316,338

[45] Feb. 23, 1982

[54] HANDHELD FIREARM ADAPTED FOR DISPENSING DEBILITATING CHEMICAL REPELLANTS

[76] Inventors: Neil E. Mason, 14 Sir Francis Drake, San Anselmo, Calif. 94960; Michael A. Dunn, 960 DeBora Ct., Fremont, Calif. 94538; James E. Mannor, 5219 Edgewater Dr., Newark, Calif. 94560

[21] Appl. No.: 64,303

[22] Filed: Aug. 6, 1979

[51] Int. Cl.[3] ..... F41C 27/00

[52] U.S. Cl. ..... 42/1 G; 42/71 P; 222/79

[58] Field of Search ..... 42/1 G, 71 R, 71 P; 222/79

[56] References Cited

U.S. PATENT DOCUMENTS 4,058,921 11/1977 Mason ..... 42/1 G

FOREIGN PATENT DOCUMENTS 118813 9/1918 United Kingdom ..... 42/1 G

*Primary Examiner*—Charles T. Jordan

*Attorney, Agent, or Firm*—Townsend and Townsend

[57] ABSTRACT

A handheld firearm such as a standard revolver adapted to dispense a debilitating chemical substance through the butt end, whereby in the shank there is a fixed or detachably mounted butt end comprising a reservoir of the debilitating chemical, such as Chemical Mace or teargas, under pressure. Valve means for dispensing the repellant is actuated by depression of a button located on the detachably mounted butt end portion of the shank, below and out of the way of the hand grip, for operation by the last digit. The presence of the reservoir of the repellant as the mounted butt end of the shank portion of the gun allows for operation without interference with a strong hand grip, avoids accidental lethal firing of the weapon, when detachably mounted permits fast recharging in the event the reservoir is depleted or in the event that there is a mechanical failure of the discharge system.

7 Claims, 5 Drawing Figures

HANDHELD FIREARM ADAPTED FOR DISPENSING DEBILITATING CHEMICAL REPELLANTS

BACKGROUND OF THE INVENTION

The present invention relates to combination weapons, and in particular, to firearms having a handgrip or butt portion adapted to dispense debilitating chemicals or repellants.

Peace officers are often equipped with a variety of devices for controlling law violators under emergency conditions. The officer's arsenal primarily includes a firearm, such as a standard revolver or pistol. Firearms, however, are highly lethal, and severe restrictions are placed on their handling and use. Therefore an officer often carries other less lethal devices, such as a billy club or a Chemical Mace dispenser, to be employed as the situation may warrant.

In many emergency or action situations, it is difficult at the outset to know whether a lethal or nonlethal weapon would be most effective. It is cumbersome and impractical to approach such situations with all possible weapons in hand. Nevertheless, circumstances in an action situation may change rapidly, calling for a different level or type of response in order to protect the officer and to avoid unnecessary harm to assailants and victims.

For example, an officer might appropriately enter a situation and approach a suspect person with a drawn firearm. In such situations, a suspect may not appear to be armed, making it highly undesirable for the officer to fire at the person for other than an overt attack, e.g., if the suspect merely fails to follow the officer's directions. Alternately, an apparently unarmed suspect may have approached close enough to the officer to wrestle the firearm from him. In either event it is highly desireable for the officer to have the option of rotating his weapon to a characteristic "safe" position, i.e., where the weapon is pointed upwardly, and discharging a debilitating substance at the suspect without losing the ability to respond with lethal force should a change in the situation so warrant.

BRIEF DESCRIPTION OF THE PRIOR ART

Combination weapons are known to the art generally, and guns adapted to dispense tear gas or a debilitating chemical are likewise known. British Pat. No. 118,813 discloses a rifle to which a cylindrical container of debilitating chemical is attached parallel to the stock and a passage "pipe" for the fluid is adapted around the trigger guard and along the barrel of the rifle to protrude beyond the end of the barrel. The cannister is bracketed to the stock and secured around the barrel by straps. Containers may be replaced by spring loading and fitting the outlet of the container with the inlet of the "pipe". The invention described in British Pat. No. 118,813 provides for discharge of the fluid in the pointed direction of the rifle. As such, the invention could be dangerous to the user and the assailant, since it can only be operated when the lethal weapon, i.e., the rifle, is pointed at the assailant. An attempt to operate the mechanism would be indistinguishable from an attempt to pull the trigger and thus would likely invite a lethal response from the assailant which would not be forthcoming if the rifle had been pointed upward. Similarly, the user could accidentally shoot the assailant when his intention was merely to discharge the debilitating chemical. Additionally, the modification of the rifle as described in the British Specification involves a significant departure from the normal shape and balance of the weapon. As such, the discharge of the rifle itself, should that be necessary, might well be impeded as to timing, accuracy and control. Further, the modification of the rifle, involves significant overhaul, including attachment of straps, piping, lugs, brackets, etc., all adding to distortion of the normal shape and balance of the rifle and the resultant interference with normal operation.

U.S. Pat. No. 4,058,921 discloses a hand gun wherein the shank is modified to enclose a cannister of debilitating chemicals which discharges through the butt end of the shank transverse to the barrel. The invention in U.S. Pat. No. 4,058,921, however, involves actuating the release of the chemical with the second or third digit by means of a button recessed in the hand grip portion of the shank. A significant disadvantage is incurred by necessitating the officer to modify his grip on the pistol in order to be at the ready position for use of the Chemical Mace dispenser. The firing of any hand gun involves a significant recoil force such that a strong hold on the hand grip portion of the shank is required in order to effectuate any degree of accuracy. Although an officer may enter a scene with his gun in an ostensibly safe position, i.e., with the barrel aimed upwardly, safety requires that the officer maintain a grip on the firearm sufficient to fire it with accuracy should the situation require it. Manipulation of the digits, i.e., placing the second or third digit lightly upon the recessed button which actuates the cannister, deprives the officer of the ability to grip the weapon in a manner sufficient to shoot normally and accurately. An additional disadvantage of the invention disclosed in U.S. Pat. No. 4,058,921 is that in the event the officer depletes the reservoir, or alternatively, in the event there is a mechanical failure of the dispensing mechanism, the officer is essentially deprived of the option of a non-lethal use of his pistol. It is inconceivable that in an action situation, even if the officer had an alternative grip kit with him, that there would be an opportunity to dismantle and reassemble the portion of his pistol containing the Mace cannister.

SUMMARY OF THE INVENTION

A hand held firearm such as a standard revolver, adapted to dispense a debilitating chemical substance through the butt end, is provided wherein the user may maintain a normal full four finger grip upon the grip portion of the shank in order to be at the ready for firing the pistol, and still have the option of utilizing the nonlethal aspect, i.e., the discharge of a debilitating chemical substance, by resting the last digit upon an actuator. The improvement comprises a novel pistol shank comprising a hand grip portion and a permanant or detachably mounted butt end. The permanent or detachably mounted butt end comprises a reservoir for containing a dispensable fluid repellant, valve means for dispensing said repellant from said reservoir and a last digit operatable actuator located on said butt end. Discharge of the chemical from the butt end is transverse to the barrel and thus may take place while the firearm itself is in an ostensibly "safe" position, i.e., pointed upwardly.

One object of the invention is to provide a dual purpose weapon which may be effectively held "at ready" for both firing and chemical discharge.

It is a further object of the invention to provide a combination weapon wherein the chemical dispensing unit may be quickly replaced in the event of either exhaustion of the contents or failure of mechanical means.

A still further object of the invention is to provide such a combination weapon with rechargeable chemical dispensing capability without modification of the shape of the weapon and with the capability of camoulflaging the removably detachable element by its being apart of the gun shank.

In particular, an object of the present invention is to provide a chemical repellant dispenser in combination with the police service revolver which can be discharged towards an assailant when the barrel of the service revolver is in an ostensibly safe position, whereby accidental shooting of the assailant is prevented without the need for the police officer to release his normal and necessarily strong hold on the hand grip of the weapon.

Other objects and advantages of the present invention will be apparent upon reference to the following detailed description of specific embodiments together with the accompanying drawings.

DETAILED DESCRIPTION OF THE PREFERRED EMBODIMENTS

Figure 1A:
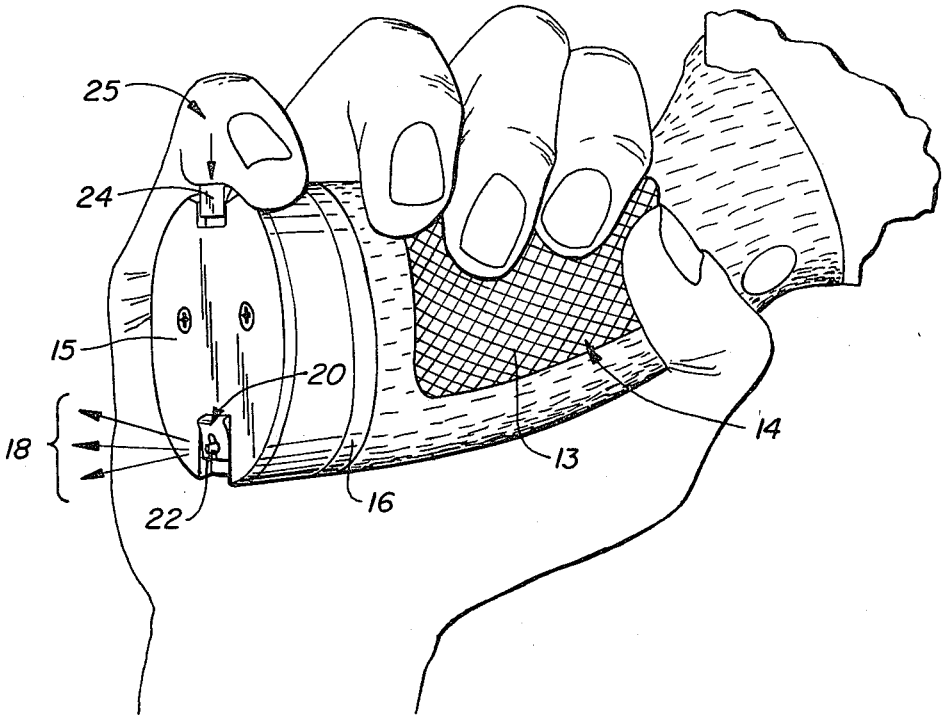
FIG. 1A is an enlargement of the combination weapon showing the dispensing of the chemical repellant.
Figure 1B:
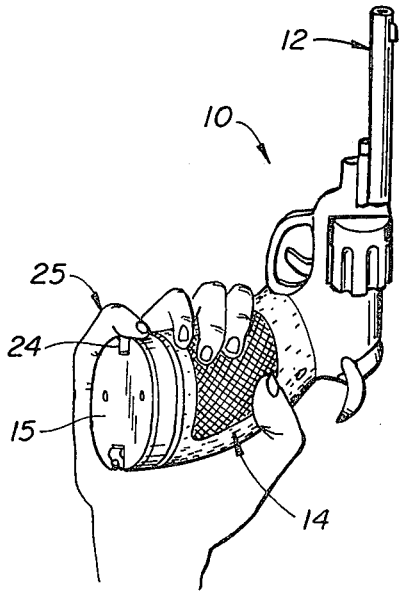
FIG. 1B is a side view of the combination weapon held in an ostensibly safe position, yet at the ready for firing either a bullet or the chemical repellant.

In FIGS. 1A and B, a handheld firearm, such as a standard service revolver 10, is illustrated, in use according to the present invention. The revolver 10, which may be a Smith & Wesson Model 19 Police Revolver, or any other handheld firearm that includes a barrel 12 and a shank 14, said shank having a hand grip portion 13 and a butt end portion 15. The term handheld firearm can include a rifle, shotgun, automatic weapon or any other weapon which has a hand grip portion similar to hand grip portion 13, the butt end of which is disposed normally to the line of fire. The butt end 15 may be permanently affixed or detachably mounted by a twist lock 16 and comprises a reservoir for containing Chemical Mace under pressure, having one surface for conforming to the butt end side of the hand grip, a side surface for continuing the cross-section of shank and a bottom surface, valve means 20 and actuating means 21 for dispensing the mace, and a nozzle 22. A button 24 or other digit confronting portion of the actuating mechanism (21) is located on the butt end in a manner such that it may conveniently be operated by the last digit 25.

Figure 2A:
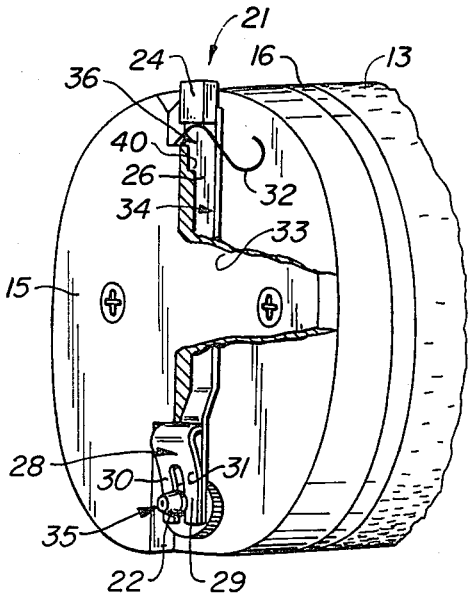
FIGS. 2A and 2B are partial cutaway views depicting the actuating mechanism both before and during dispensing of the repellant.
Figure 2B:
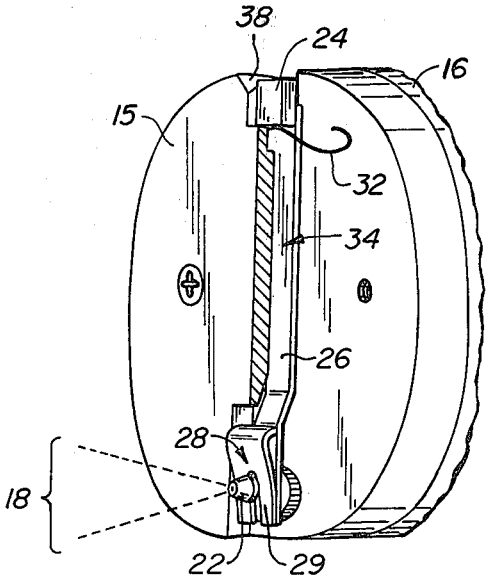

FIG. 2A is a partial cutaway showing operation of the actuating mechanism 21 which comprises a button 24 connected by a rod 26 to a nozzle engaging element 28. The nozzle engaging element 28 is wedge-shaped and forked at its tapered end 29 into two tines 30, 31 which engage the annulus 35 of the frustoconical shaped nozzle head 22. The nozzle head 22 is connected by means of a neck and through a spray adjusting mechanism to the valve dispensing means in a manner such that transverse movement of the head 22 outward from the butt end 15, as depicted in FIG. 2*b*, results in release of the mace and return to its original position terminates the dispensing.

The actuating mechanism is disposed in a substantially U-shaped channel 36 in the outward side of the butt end 15 opposite from the side detachably mounted to the hand grip portion 13. The channel has a chamfer 38 at one end for ease of access to the actuating button 24. Toward the opposite end of the channel the nozzle head 22 is located. Between the chamfer and the nozzle the channel has a gradual ramp-type elevation toward the nozzle end. The connecting rod 26 has a bend conforming to the ramp shape of the channel whereby the forked wedged shaped element is raised so that the tines 30, 31 circularly engage the neck of the nozzle above spray adjusting mechanism 35.

Transverse to the U-shaped channel 36 toward the chamfered end of the channel is an intersecting milled slot 40 containing a bow-shaped spring mechanism 32. In operation digit pressure causes the button 24 to depress the center of the bowed spring and at each end the spring presses against the sides of the slot and is curling inward. As the spring 32 deforms, the button 24 moves along the channel 36, moving the rod 26 and thus the wedge shaped element 28. As the wedge shaped tines 30, 31 move further under the nozzle neck, the nozzle head 22 if forced outward causing a release of the mace. Upon release of the digit pressure, the spring 32 returns to its original shape pushing the button toward the chamfer, allowing the nozzle head to move inward, stopping the dispensing action. A confronting element 33 covers the channel 36 and encloses the spring 32 and the rod 26.

In the embodiment depicted, the butt end 15 is detachably mounted to the hand grip portion 13 and made a part of the gun shank by means such as a twist lock 50.

Figure 3:
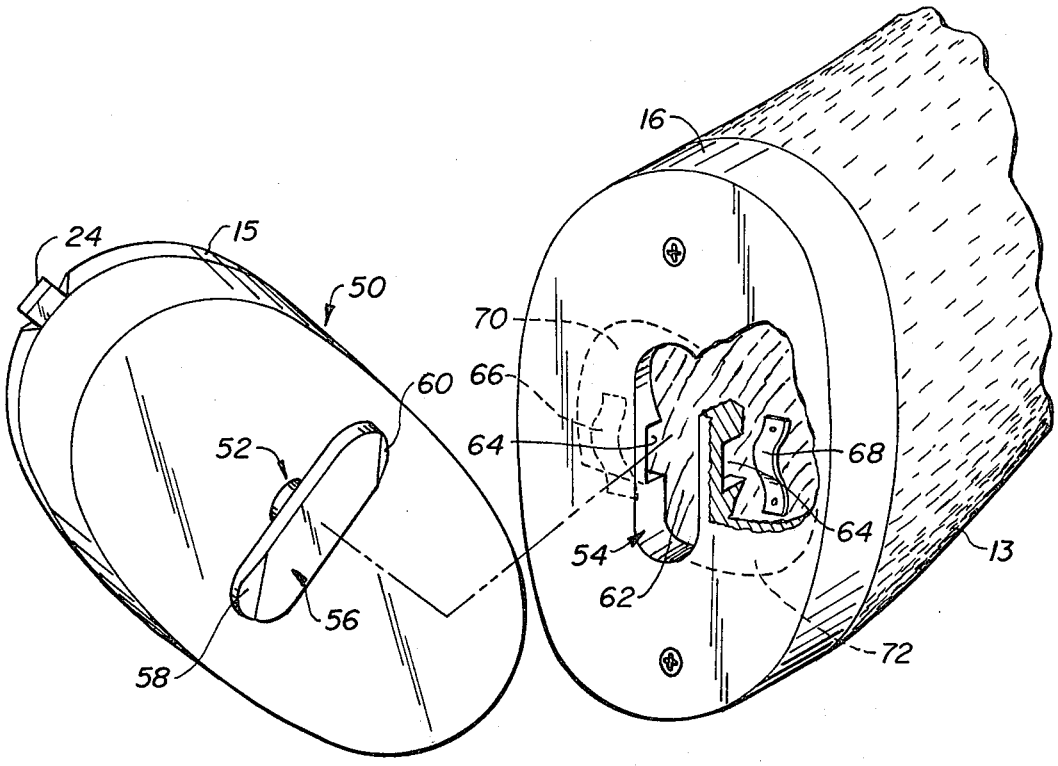
FIG. 3 is an exploded perspective view of a removable butt depicting the twist lock mounting mechanism.

In the preferred embodiment depicted in FIG. 3, the twist lock 50 is easily and quickly operated and comprises a male fitting 52 mounted to the butt end 15 and a female fitting 54 mounted to the hand grip portion 13. The male fitting 52 has an enlarged elliptical head 56 with beveled portions (58,60) of two opposite edges.

The female fitting has two recessed cavities 62, 64, a receiving cavity 62 for the male fitting and a "lock-position" cavity which is more recessed than the receiving cavity 62 and transverse to it. Connecting the two cavities on opposite sides are two slots 70, 72 through which the elliptical male head 56 may rotate 90° to align with either of cavities 62, 64. Two leaf spring 66, 68 are disposed such that the male head 56 is firmly fixed in the "lock position" cavity 64.

Where the officer is right handed, "lock position" may be achieved by inserting the male head 56 and rotating 90° clockwise. For left-handed officers a twist locked may be provided whereby lock position is obtained by 90° rotation counterclockwise. The advantage of this is that in each case last digit pressure during operation or gripping cannot move the butt end 15 relative to hand grip portion 13.

The invention has been described with respect to the specific embodiments. Other embodiments will be suggested to those of ordinary skill in the art in light of the disclosure. For example, other actuating mechanisms and means for permanent affixing or detachable mounting may be employed. Moreover, the repellant containing cannister need not necessarily be of the aersol type if a suitable discharge mechanism is employed.

In view of the foregoing detailed description of the embodiments according to the present invention, it is not intended that this invention be limited except as indicated by the appended claims.

We claim:

1. In a handheld firearm comprising a barrel and a shank portion, said shank portion comprising a hand grip portion and a butt end, the improvement comprising in the shank portion, a mounted butt and comprising a reservoir for containing a dispensible fluid repellant, actuating means for dispensing said repellant from said reservoir, a last digit operatable actuator including a button located in said butt end, a nozzle being disposed in said butt whereby discharge of said repellant from said firearm is transverse to said barrel; and said actuating means comprises a connecting rod from said button and a forked wedge-shaped element to lift said nozzle whenever a force is exerted on said button.

2. A detachably mountable butt end portion for a hand-held firearm comprising a barrel, shank, and a hand grip portion of the shank and at least a first coupling member mounted to said shank, said butt end portion comprising:

a reservoir for containing a dispensible fluid repellant having a first surface for conforming to the butt end of said hand grip, a second side surface for continuing the cross-section of said butt end, and a bottom surface, actuating means for dispensing said repellant from said reservoir at said bottom surface, a last digit operatable actuator located on said butt end, and a nozzle being disposed from said bottom surface on said butt whereby discharge of said repellant from said butt when mounted is transverse to said barrel, and at least a second coupling member mounted to said first surface to confront said first coupling member and fasten said reservoir to said butt whereby the shank portion of said firearm is continued by the removeable attachment of said butt end between said first and second coupling members.

3. A butt end according to claim 2, detachably mountable by means of a twist lock, said first coupling member comprising a male coupling member and said second coupling member comprising a female coupling member.

4. A butt end according to claim 2 wherein a locked position is attained by insertion of the male coupling member in the female coupling member and clockwise rotation.

5. A butt end according to claim 2 wherein a locked position is attained by insertion of the male coupling member in the female coupling member and counterclockwise rotation.

6. A kit for modifying a handheld firearm having a barrel and an attached hand grip portion, said kit for modifying said hand grip portion to additionally dispense a fluid repellant transverse to said barrel, said kit comprising:

a mountable butt end to said hand grip portion, said butt end comprising a reservoir for containing a dispensable fluid repellant having a first surface for confronting to said hand grip, second side surface(s) for continuing the cross-section of said hand grip, and a bottom surface disposed away from said barrel at the portion of said reservoir remote from said barrel; actuating means for dispensing said repellant from said reservoir at said bottom surface, a digit operatable actuator, and a nozzle located on said bottom surface, a first coupling member for attachment to said hand grip portion and a second coupling member attached to said reservoir and extending across said first surface.

7. A kit according to claim 6 wherein said mountable butt end is detachably mountable and said first and second coupling members mated for removeably detachable engagement whereby said reservoir is removeably detachable from said firearm.

* * * * *